US011600207B2

(12) United States Patent
Larsen et al.

(10) Patent No.: US 11,600,207 B2
(45) Date of Patent: Mar. 7, 2023

(54) RETAIL DISPLAY HEADER AND ASSOCIATED ASSEMBLIES

(71) Applicant: TARGET BRANDS, INC., Minneapolis, MN (US)

(72) Inventors: Selina Larsen, Duluth, MN (US); Jacob K. Pomputis, Lakeville, MN (US); Scott J. Fuenffinger, Centerville, MN (US)

(73) Assignee: Target Brands, Inc., Minneapolis, MN (US)

( * ) Notice: Subject to any disclaimer, the term of this patent is extended or adjusted under 35 U.S.C. 154(b) by 138 days.

(21) Appl. No.: 16/950,900

(22) Filed: Nov. 17, 2020

(65) Prior Publication Data

US 2022/0157204 A1 May 19, 2022

(51) Int. Cl.

| | |
|---|---|
| ***G09F 7/18*** | (2006.01) |
| ***E04H 1/12*** | (2006.01) |
| ***A47F 5/00*** | (2006.01) |

(52) U.S. Cl.

CPC ..... *G09F 7/18* (2013.01); *A47F 5/0018* (2013.01); *A47F 5/0043* (2013.01); *E04H 1/1272* (2013.01); *G09F 2007/1843* (2013.01); *G09F 2007/1856* (2013.01)

(58) Field of Classification Search

None

See application file for complete search history.

(56) References Cited

U.S. PATENT DOCUMENTS

| | | | | |
|---|---|---|---|---|
| 620,522 A | | 2/1899 | Williams | |
| 1,758,511 A | * | 5/1930 | Gross | B65D 5/2095 229/172 |
| 2,023,419 A | * | 12/1935 | Hailparn | G09F 1/06 40/539 |
| 4,113,109 A | | 9/1978 | Donnelli et al. | |
| 4,122,604 A | | 9/1978 | Ott et al. | |
| 4,334,374 A | | 6/1982 | Spamer et al. | |

(Continued)

OTHER PUBLICATIONS

Dr. Pepper Display Sign Photograph, printed from https://i.pinimg.com/originals/cb/56/b0/cb56b078ebb645f2efcd2e7ce8377c16.jpg, publicly available at least as early as Mar. 20, 2020 (1 page).

(Continued)

*Primary Examiner* — David R Dunn
*Assistant Examiner* — Christopher E Veraa
(74) *Attorney, Agent, or Firm* — Griffiths & Seaton PLLC; JoAnn M. Seaton

(57) ABSTRACT

A header box for a retail display structure comprising a front panel, a rear panel, and a bottom panel. The rear panel is formed coplanarly with the front panel and the bottom panel and is folded about a first fold line of the header box relative to the front panel to extend entirely spaced from and substantially parallel to the front panel. The rear panel defines a depending flange extending downwardly from a remainder of the rear panel. The bottom panel is folded about a second fold line of the header box to extend between the rear panel and the front panel and is positioned above a bottommost edge of the front panel and above the depending flange of the rear panel. A reception cavity for receiving a cross bar of the retail display structure is formed between the front panel and the depending flange and below the bottom panel.

19 Claims, 15 Drawing Sheets

(56) References Cited

U.S. PATENT DOCUMENTS

| | | | | |
|---|---|---|---|---|
| D268,010 | S | 2/1983 | O'Brien | |
| 4,379,373 | A | 4/1983 | Transport | |
| 4,672,757 | A | 6/1987 | Field | |
| 4,704,813 | A * | 11/1987 | Fast | G09F 1/14 40/324 |
| 4,809,453 | A * | 3/1989 | Morgan | G09F 1/04 40/491 |
| 5,123,189 | A | 6/1992 | Fast et al. | |
| D400,438 | S | 11/1998 | Correll | |
| 6,163,996 | A * | 12/2000 | Gebka | G09F 3/204 40/661 |
| 6,167,644 | B1 | 1/2001 | Fox | |
| D501,341 | S | 2/2005 | Cassidy et al. | |
| D512,462 | S | 12/2005 | Matuel et al. | |
| D723,844 | S | 3/2015 | Hawkins | |
| 9,082,323 | B1 * | 7/2015 | Dougherty | G09F 23/06 |
| D741,408 | S | 10/2015 | Engelby et al. | |
| 9,215,940 | B2 | 12/2015 | Hawkins | |
| 9,930,913 | B2 | 4/2018 | Fath | |
| 9,978,295 | B1 * | 5/2018 | Denby | G09F 15/0062 |
| 10,123,634 | B2 | 11/2018 | Volz et al. | |
| 10,322,735 | B2 | 6/2019 | Parker | |
| 10,672,302 | B1 * | 6/2020 | Schultz | A47F 5/0846 |
| 10,896,629 | B1 * | 1/2021 | Frost | G09F 1/065 |
| 10,971,038 | B2 | 4/2021 | Shea | |
| 2005/0193893 | A1 * | 9/2005 | Poston | G09F 23/06 99/342 |
| 2005/0210724 | A1 * | 9/2005 | Grau | G09F 15/00 40/607.13 |
| 2010/0199535 | A1 * | 8/2010 | Reynolds | G09F 15/00 40/624 |
| 2012/0193311 | A1 * | 8/2012 | Benasillo | A47F 5/10 29/525.01 |
| 2013/0232836 | A1 * | 9/2013 | Holt | G09F 15/0056 40/606.01 |
| 2013/0240134 | A1 | 9/2013 | Flynn et al. | |

OTHER PUBLICATIONS

Larsen, Selina. U.S. Appl. No. 16/950,114, filed Nov. 17, 2020 (35 pages).

* cited by examiner

RETAIL DISPLAY HEADER AND ASSOCIATED ASSEMBLIES

BACKGROUND OF THE INVENTION

Signs are commonly used in retail settings to present information to customers about a promotion and/or a product for purchase. For example, overhead signs are hung over a grouping of display structures including related products and are used to indicate a general location of the products. Upright signs can be positioned adjacent display structures or in aisles between display structures to direct the customer to a product location or to inform the customer of sales or promotions. In other instances, signs are attached directly to the display structures, such as on shelving, to provide identifying and/or price information to the customer.

SUMMARY

One aspect of the present invention relates to a header box configured to be coupled to a retail display structure. The header box comprises a front panel, a rear panel, and a bottom panel. The front panel has a bottommost edge. The rear panel is initially formed coplanarly with the front panel and is folded about a first fold line of the header box relative to the front panel to extend entirely spaced from and substantially parallel to the front panel. The rear panel defines at least one depending flange extending downwardly from a remainder of the rear panel. The bottom panel is initially formed coplanarly with each of the front panel and the rear panel and bordering the rear panel about a second fold line. The bottom panel is folded about the second fold line to extend between the rear panel and the front panel, and the bottom panel is positioned above the bottommost edge of the front panel and above the at least one depending flange of the rear panel. A reception cavity is formed between the front panel and the at least one depending flange and below the bottom panel for slidably receiving a cross bar of the retail display structure such that the bottom panel contacts the cross bar and the header box fits atop the cross bar. Other systems, fixtures, header boxes, assemblies, methods, etc. are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" each applies to all numeric values or descriptive terms, respectively, and generally indicate a range of numbers or characteristics that one of skill in the art would consider equivalent to the recited values or terms, that is, having the same function or results.

A header box is provided for displaying indicia on a retail display fixture, as part of a retail display system, and is configured to draw the attention of consumers, to inform consumers about the price or other features of items offered for retail sale, to enhance aesthetics of a retail environment, to identify the items offered for retail sale near the header box, and/or to direct a consumer toward the location of items offered for retail sale. In one embodiment, the header box is formed of a single, substantially planar blank folded about fold lines and perforations to form a retention channel for receiving a cross bar of the retail display fixture. The retention channel is fully hidden from view when header box is viewed from a front perspective and retention channel is open with a downward orientation configured to receive a cross bar of a retail display fixture such that the header box extends in a longitudinal direction largely covering a front of the cross bar of the retail display fixture.

Figure 1:
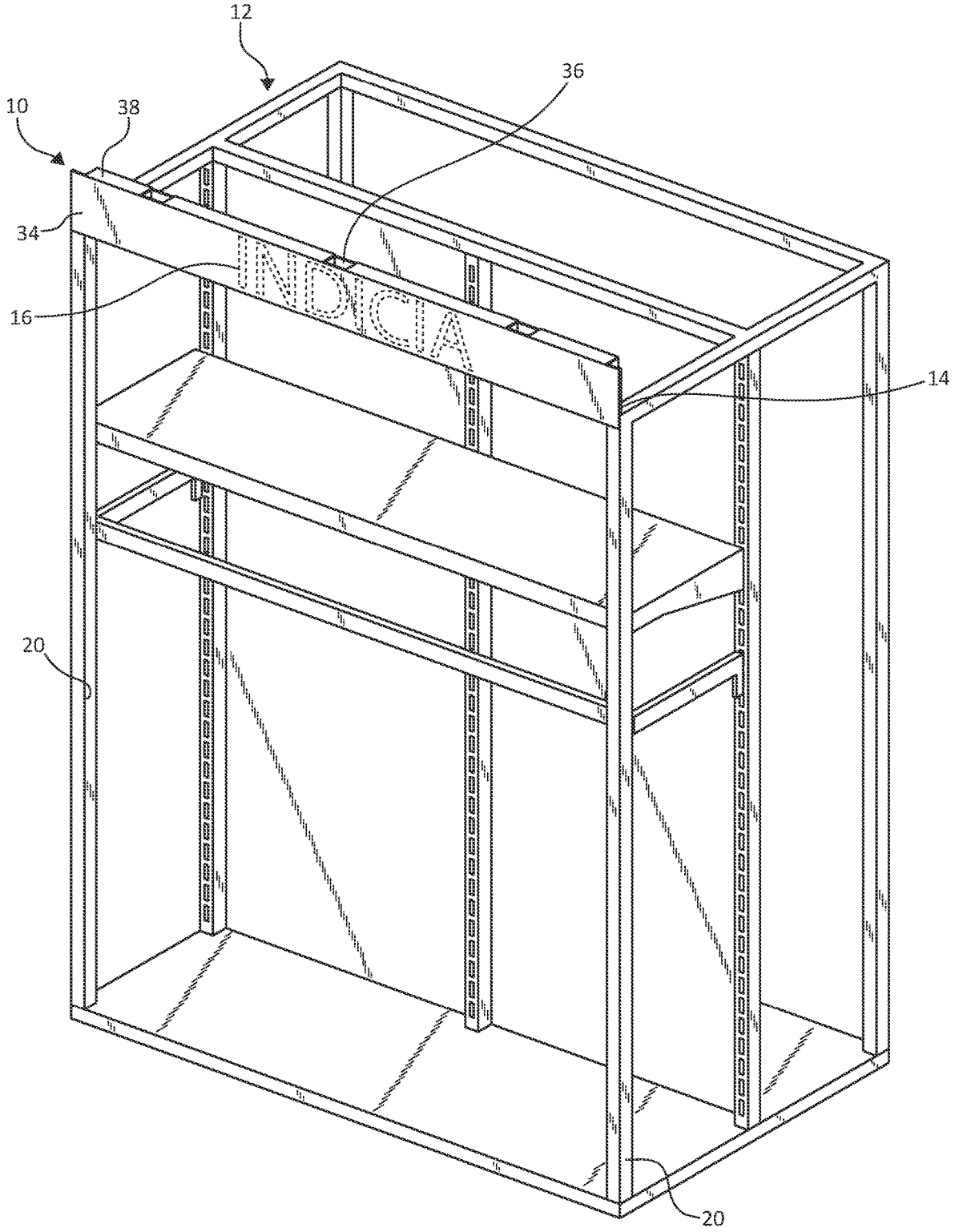
FIG. 1 is a front, perspective view illustration of a retail display system including a retail display fixture with a header box supported thereon, according to one embodiment of the present invention.
Figure 2:
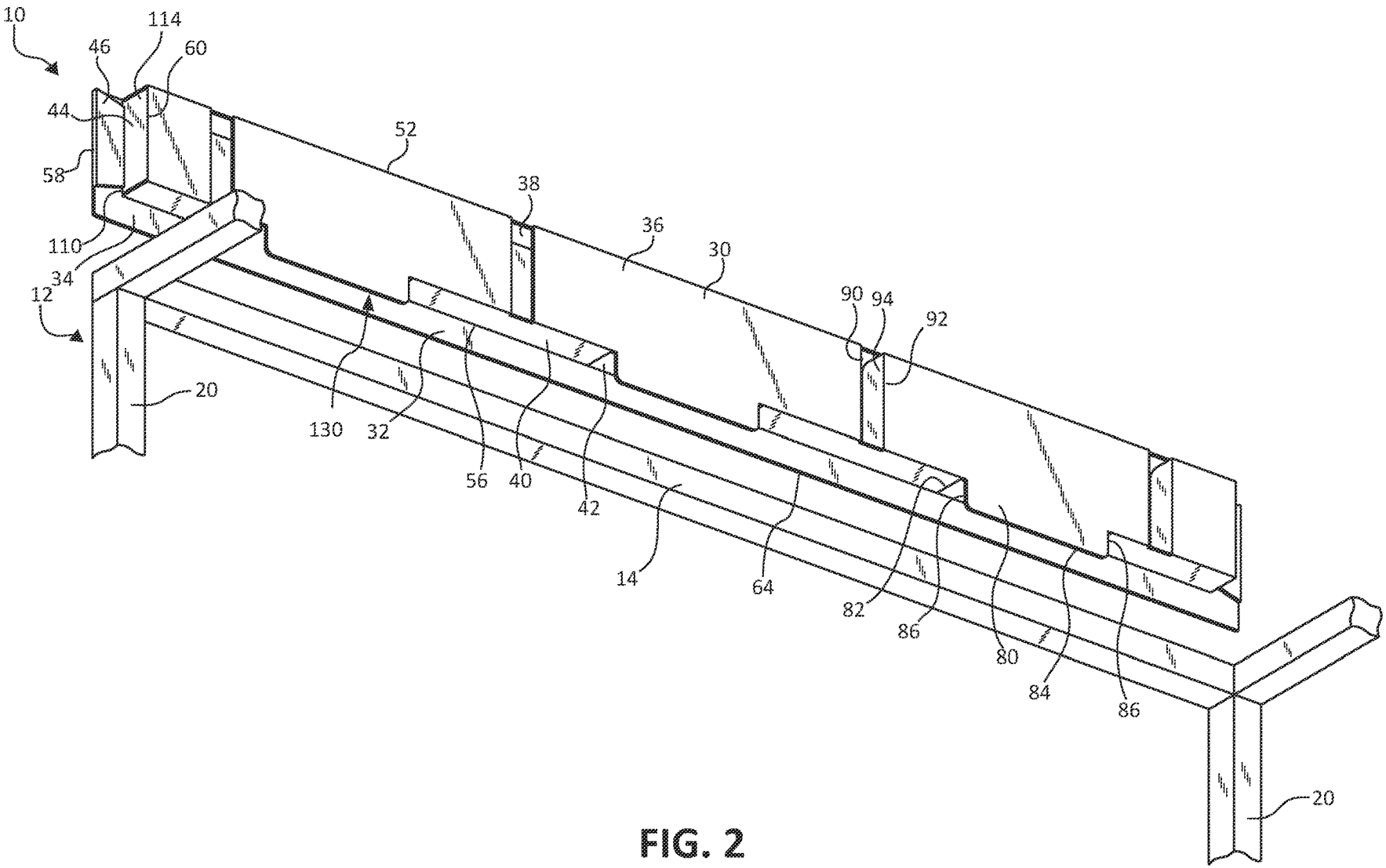
FIG. 2 is a rear, perspective view illustration of a portion of the retail display system of FIG. 1, according to one embodiment of the present invention.
Figure 3:
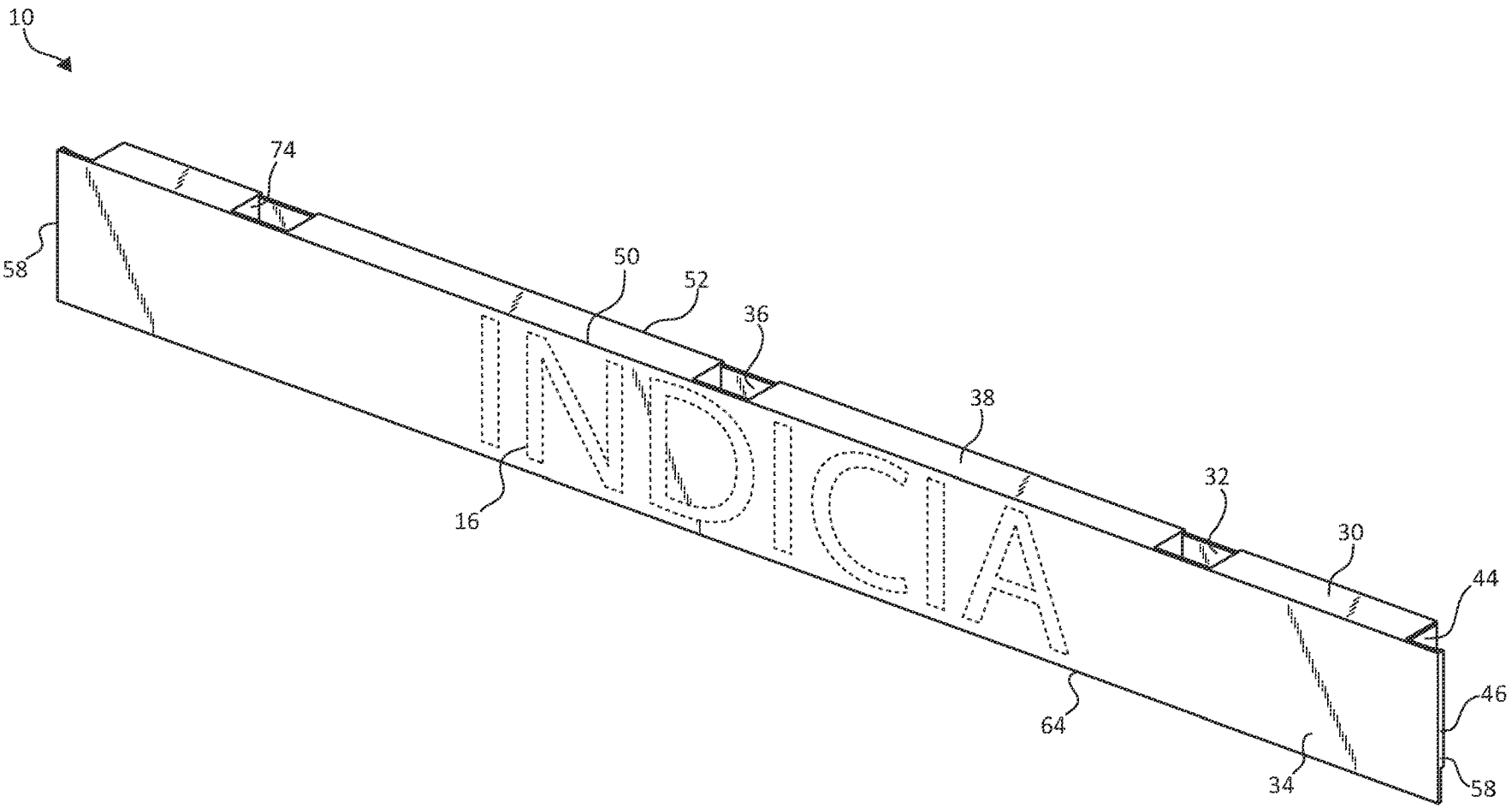
FIG. 3 is front, perspective view illustration of the header box of FIG. 1, according to one embodiment of the present invention.
Figure 4:
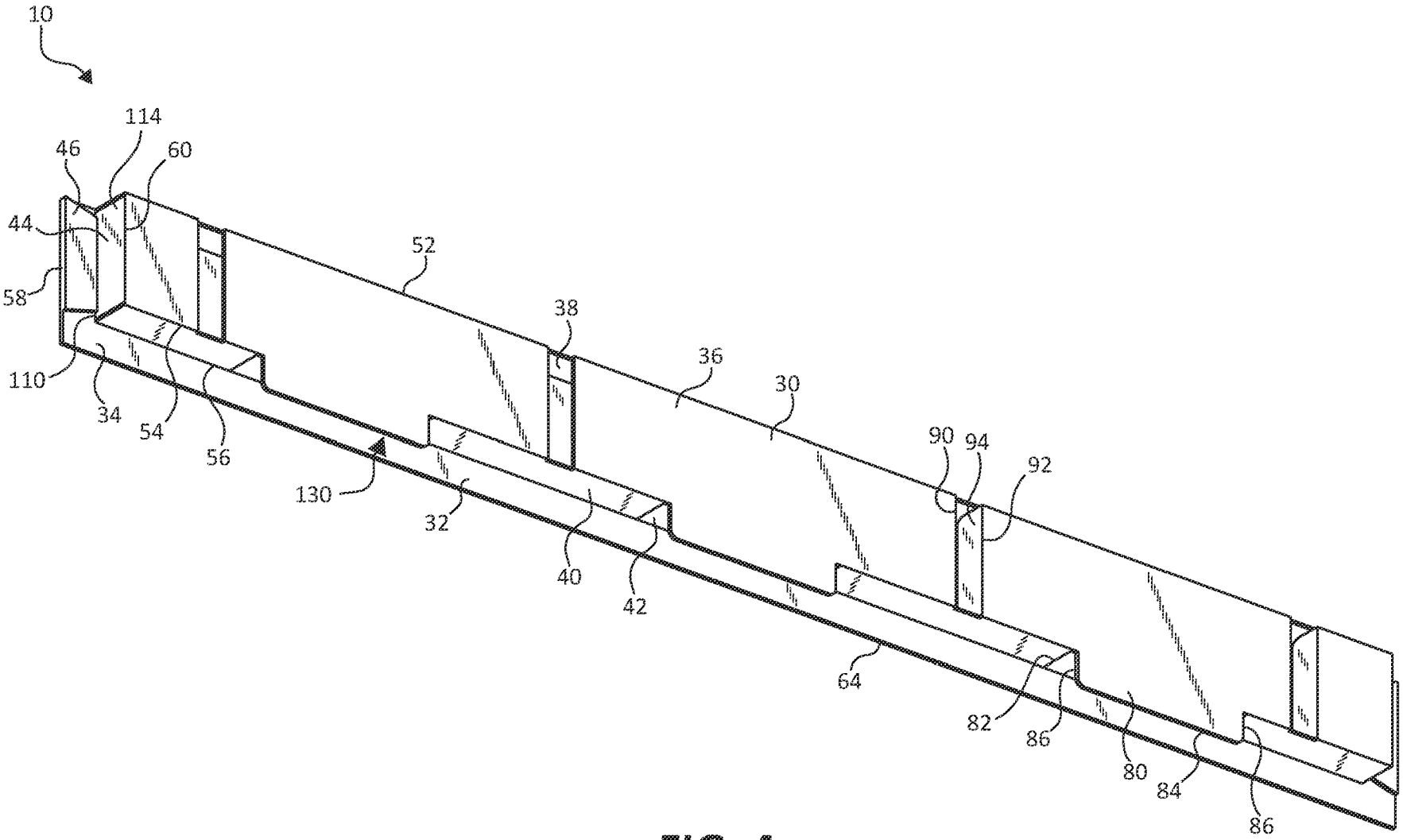
FIG. 4 is a rear, perspective view illustration of the header box of FIG. 3, according to one embodiment of the present invention.
Figure 5:
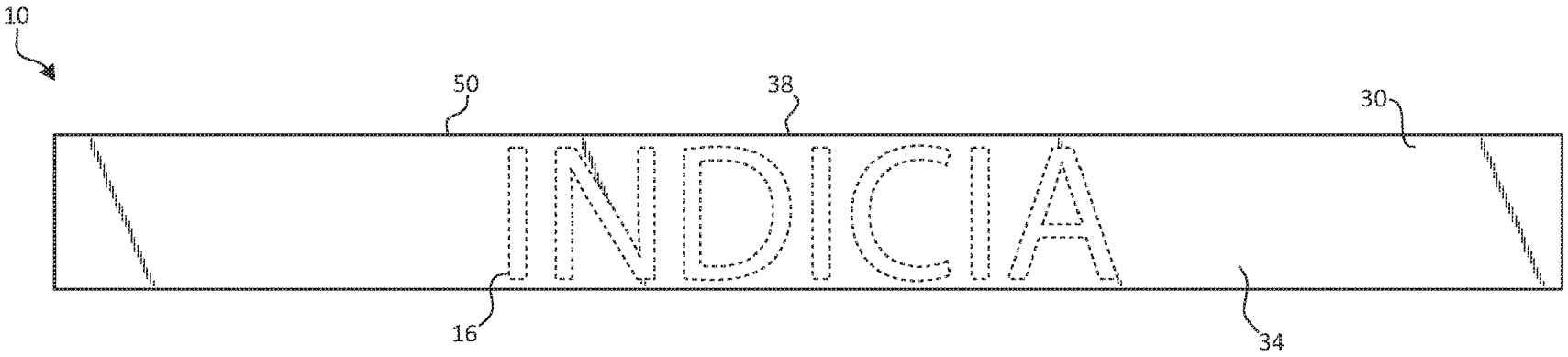
FIG. 5 is a front view illustration of the header box of FIG. 3, according to one embodiment of the present invention.
Figure 6:
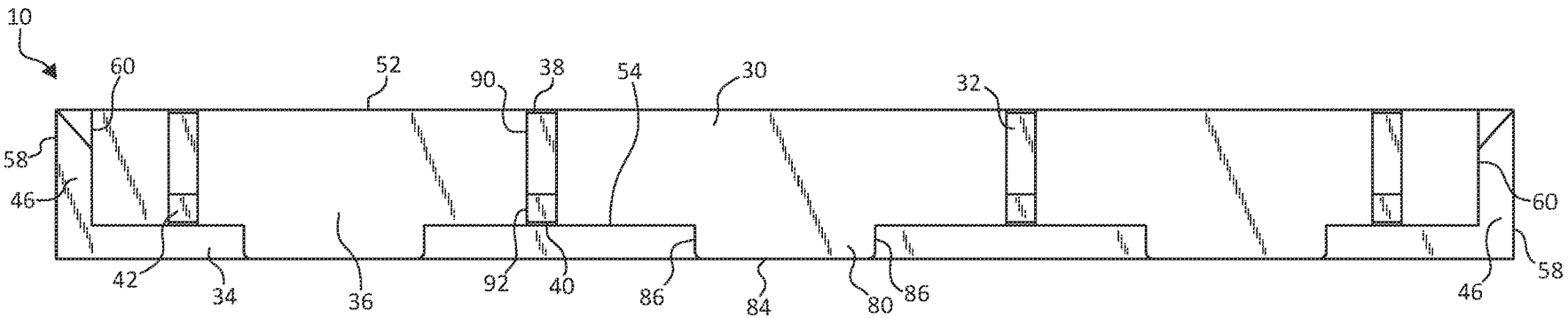
FIG. 6 is a rear view illustration of the header box of FIG. 3, according to one embodiment of the present invention.
Figure 8:
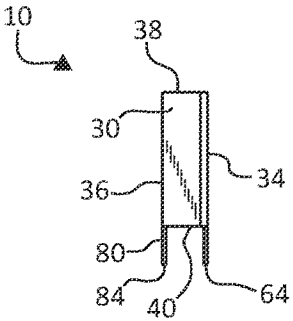
FIG. 8 is a left side view illustration of the header box of FIG. 3, according to one embodiment of the present invention.
Figure 7:
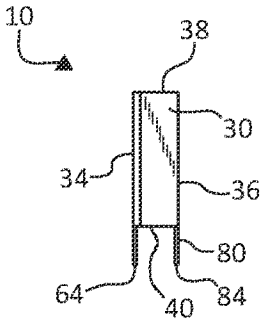
FIG. 7 is a right side view illustration of the header box of FIG. 3, according to one embodiment of the present invention.
Figure 9:
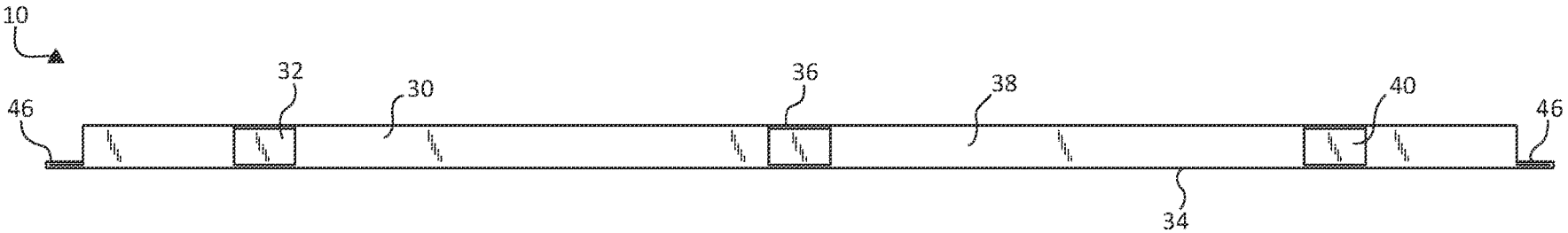
FIG. 9 is a top view illustration of the header box of FIG. 3, according to one embodiment of the present invention.
Figure 10:
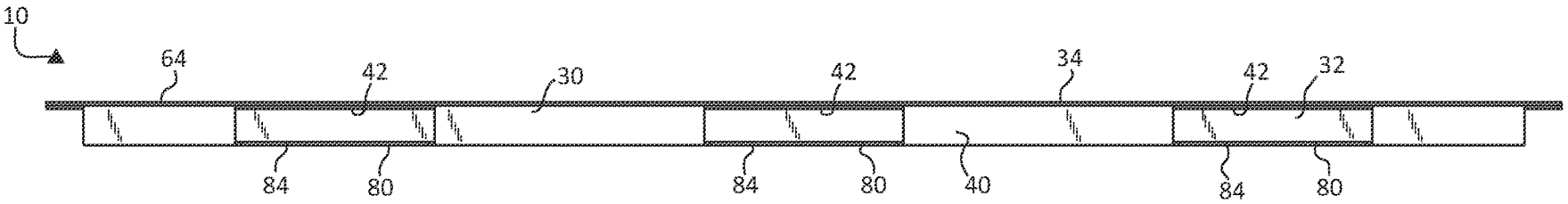
FIG. 10 is a bottom view illustration of the header box of FIG. 3, according to one embodiment of the present invention.

Turning to the figures, FIGS. 1 and 2 illustrate one example of a retail display system including a header box 10 and a retail display fixture 12, for example, including a cross bar 14 extending between two vertical support members 20. Header box 10 including indicia 16, such as graphics, text, colors, etc. on a front surface thereof, and is formed with an open retention channel 22 as shown, for example, in the fully assembled views of header box 10 in FIGS. 3-10. Open retention channel 22 is configured to fit over cross bar 14 in a manner supporting header box 10 on cross bar 14. More specifically, a front surface of header box 10 generally extends in parallel to and covers a front surface of cross bar 14, as will be further described below.

The retail fixture members, that is, the assembly of vertical support members 20, cross bar 14, and any other may be positioned within a retail store or environment in any desired position, such as, along a wall of the environment and/or spaced from any said interior or exterior walls of the environment. The retail fixture is, on one example, configured to support goods for retail sale within the environment. Header box 10 is configured to brand or market such products or environment and/or provide information to potential consumers viewing header box 10.

Figure 11:
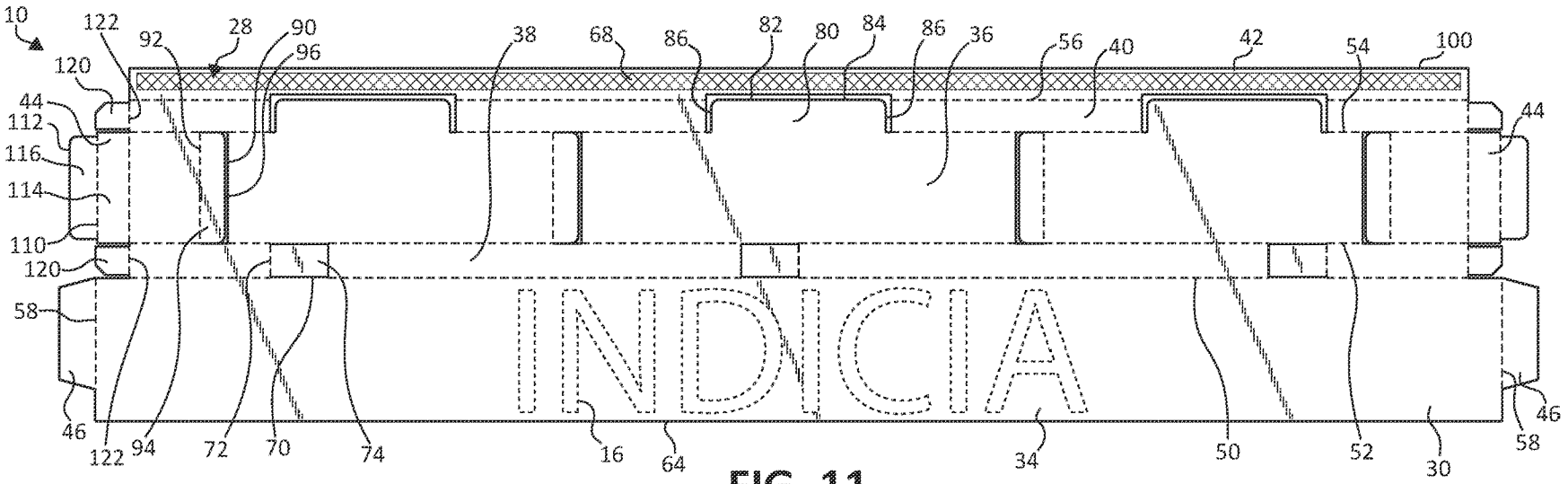
FIG. 11 is a front view illustration of an unfolded header box blank for forming the header box of FIG. 3, according to one embodiment of the present invention.
Figure 12:
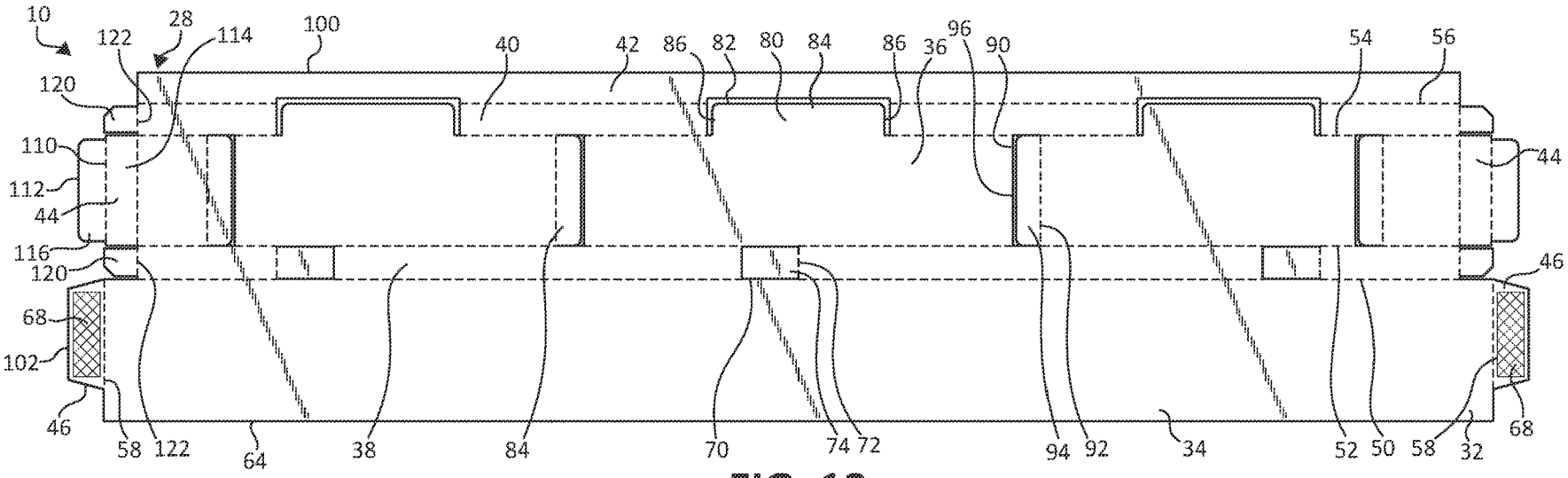
FIG. 12 is a rear view illustration of the unfolded header box blank of FIG. 11, according to one embodiment of the present invention.

Header box 10 as shown in FIGS. 3-10 is initially formed of a substantially planar member in the form of a blank 28 as shown in FIGS. 11 and 12. Blank 28 is formed of paperboard, cardboard, pressed paper, plastic or other suitable material able to fold along defined fold lines and is configured with perforations cut therein to allow blank 28 to be folded to become header box 10. In one embodiment, blank 28 defines a first or exterior surface 30 and a second or interior surfaced 32, opposite exterior surface 30. Each of exterior surface 30 and interior surface 32 are substantially planar and is in a parallel plane with the other of exterior surface 30 and interior surface 32.

Blank 28 is scored, marked, or otherwise formed with a plurality of fold lines 50, 52, 54, 56, 58, and 60, for example, defining a front panel 34, a rear panel 36, a top panel 38, a bottom panel 40, long coupling flange 42, side panels 44, and lateral finishing flanges 46, in one embodiment. For example, front panel 34 extends from a bottom free edge 64, otherwise referred to as a bottommost edge, to a first fold line 50 in a substantially rectangular manner where bottom free edge 64 and first fold line 50 extend substantially parallel to one another. In one embodiment, front panel 34 is entirely continuous and/or includes indicia 16 printed on the portion of exterior surface 30 formed by front panel 34.

Top panel 38 extends from first fold line 50, opposite front panel 34, to a second fold line 52, which, in one example, extends substantially parallel to first fold line 50. First fold line 50 defining a topmost edge of top panel 38, in one example. In one embodiment, top panel 38 additionally defines C-shaped cuts 70 with a transverse fold line 72 extending from each end of C-shaped cuts 70. Each C-shaped cut 70 includes front and back sections, each substantially colinear with a different one of first fold line 50 and second fold line 52, and a transverse section extending from one end of each front and back section to the other to form the C-shape of C-shaped cuts 70. A transverse fold line 72 extends from the ends of front and back sections of each one of C-shaped cuts 70 opposite their intersection with transverse section of C-shaped cut 70. In one embodiment, transverse fold line 72 extends along a substantial entirety of a width of top panel 38, that is from second fold line to third fold line 54. The area of top panel inside C-shaped cut 70 and transverse fold line 72 serves as a spacing tab 74 foldable about fold line 72, as will be further described in assembly of header box 10.

Rear panel 36, according to one embodiment, generally extends from second fold line 52 along which it borders bottom panel 40, opposite top panel 38, to third fold line 54, which, in one example, is substantially parallel to second fold line 52. Portions of rear panel 36, however, extend from second fold line 52 past and beyond third fold line 54 forming at least two depending flanges 80. More specifically, in one embodiment, a longitudinally orientated C-shaped slot 82 is formed around each one of depending flanges 80 defining three-sides of the perimeter of each depending flanges 80, that is extending from two ends of depending flanges 80 adjacent third fold line 54 toward and, in some embodiments, to or beyond fourth fold line 56. In this manner, each depending flange 80 extends from third fold line 54 to a free end 84, substantially parallel to third fold line 54 and two transverse edges 86 on either side thereof extending between free end 84 and third fold line 54. As such, each depending flange 80 is elongated in a longitudinal direction substantially parallel to first, second, and third fold lines 52, 54, and/or 56.

Additionally, in one embodiment a transversely orientated, C-shaped slit 90 is formed through rear panel 36 in a manner extending from second fold line 52 to third fold line 54. More specifically, each C-shaped slit 90 includes front and back sections, each substantially colinear with a different one of second fold line 52 and third fold line 52, and a transverse section extending from one end of each front and back section to the other to form the C-shape of each C-shaped slit 90. A transverse fold line 92 extends from the ends of front and back sections of each one of C-shaped slits 90 opposite their intersection with transverse section of C-shaped slit 90. In one embodiment, transverse fold line 92 extends along a substantial entirety of a height of rear panel 36, that is from second fold line 52 to third fold line 54. The area of top panel inside C-shaped slit 90 and transverse fold line 92 serves as a spacing tab 94 foldable about fold line 92, as will be further described in assembly of header box 10. Each spacing tab 94 extends from a respective one of transverse fold lines 92 to a free end 96, extending substantially parallel to the respective one of transverse fold lines 92. In one embodiment, all of spacing tabs 94 are formed to extend in a single direction away from their respective fold line 92, while, in another embodiment, different ones of spacing tabs 94 extending in opposite direction way from their respective fold line 92 such that C-shaped slit 90 is in an opposite direction as compared with typical C-shape.

In one embodiment, bottom panel 40, extends away from third fold line 54 in a direction opposite rear panel 36 to fourth fold line 56, which, in one example, is substantially parallel to second fold line 52. A width of bottom panel 40 is defined between third fold line 54 and fourth fold line 56, and, in one example, is substantially equal to a width of top panel 38 defined between first fold line 50 and second fold line 52. In one embodiment, bottom panel 40 is discontinuous and is divided into segments by depending flanges 80 extending upwardly through bottom panel 40 from rear panel 36.

Longitudinal coupling flange 42 extends from fourth fold line 56 away from bottom panel 40 to a free end 100. In one embodiment, free end 100 extends substantially parallel with one or more of first fold line 50, second fold line 52, third fold line 54, and fourth fold line 56. In one embodiment, longitudinal coupling flange 42 is continuous longitudinally between opposing ends thereof, while in other embodiments, longitudinal coupling flange 42 is discontinuous.

Header box 10 may or may not include end components to assist in finishing the look of header box 10 and/or providing additional rigidity and stability to header box 10. In one embodiment including end components, header box 10 defines at least two lateral finishing flanges 46 each extending from an opposite end of front panel 34, more specifically, in one instance, from a transverse fold line 58 at least partially defining an end of front panel 34. Each lateral finishing flange 46 extends away from the front panel 34 end to a free end 102. Each lateral finishing flange 46 is of equal or lessor height as front panel 34.

In one embodiment, additional end component of header box 10 include side panels 44, which each extend away from an opposite end of rear panel 36. More specifically, in one instance, each side panel 44 extends away from a transverse fold line 122 extending across at least rear panel 36, and in one embodiment, across each of top panel 38, rear panel 36, and longitudinal coupling flange 42 in a linear manner. Side panel 44, in one example, extends from transverse fold line 122 to a free end 112 with a height greater than about 90% of a height of rear panel, in one embodiment. Side panel 44 is divided substantially in half via a divider fold line 110 extending substantially parallel to transverse fold line 122. In one embodiment, transverse fold line 122 and divider fold line 110 are spaced apart a distance substantially similar to a distance between first fold line 50 and second fold line 52 and/or a distance between third fold line 54 and fourth fold line 56. Divider fold line 110 divides side panel 44 into a first portion 114, which is adjacent rear panel 36, and a second portion 116, which is adjacent free end 112. In one example, side flanges 120 are defined at opposing ends of each of bottom panel 40 and/or top panel 38, that is from a portion of fold line 122 adjacent each of bottom panel 40 and top panel 38, respectively, as will be further described below.

In one embodiment, one or more of front panel, long coupling flange 42 and lateral coupling flange 26 is includes pre-applied adhesive 68 or is applied with adhesive 68 during assembly to hold header box 10 in an assembled position substantially without the use of other tools or securement mechanisms, in one example. Other portions of header box 10 may also make use of pre-applied or other adhesive 68 in assembling header box 10 as will be apparent to those of skill in the art upon reading the present application.

Figure 13:
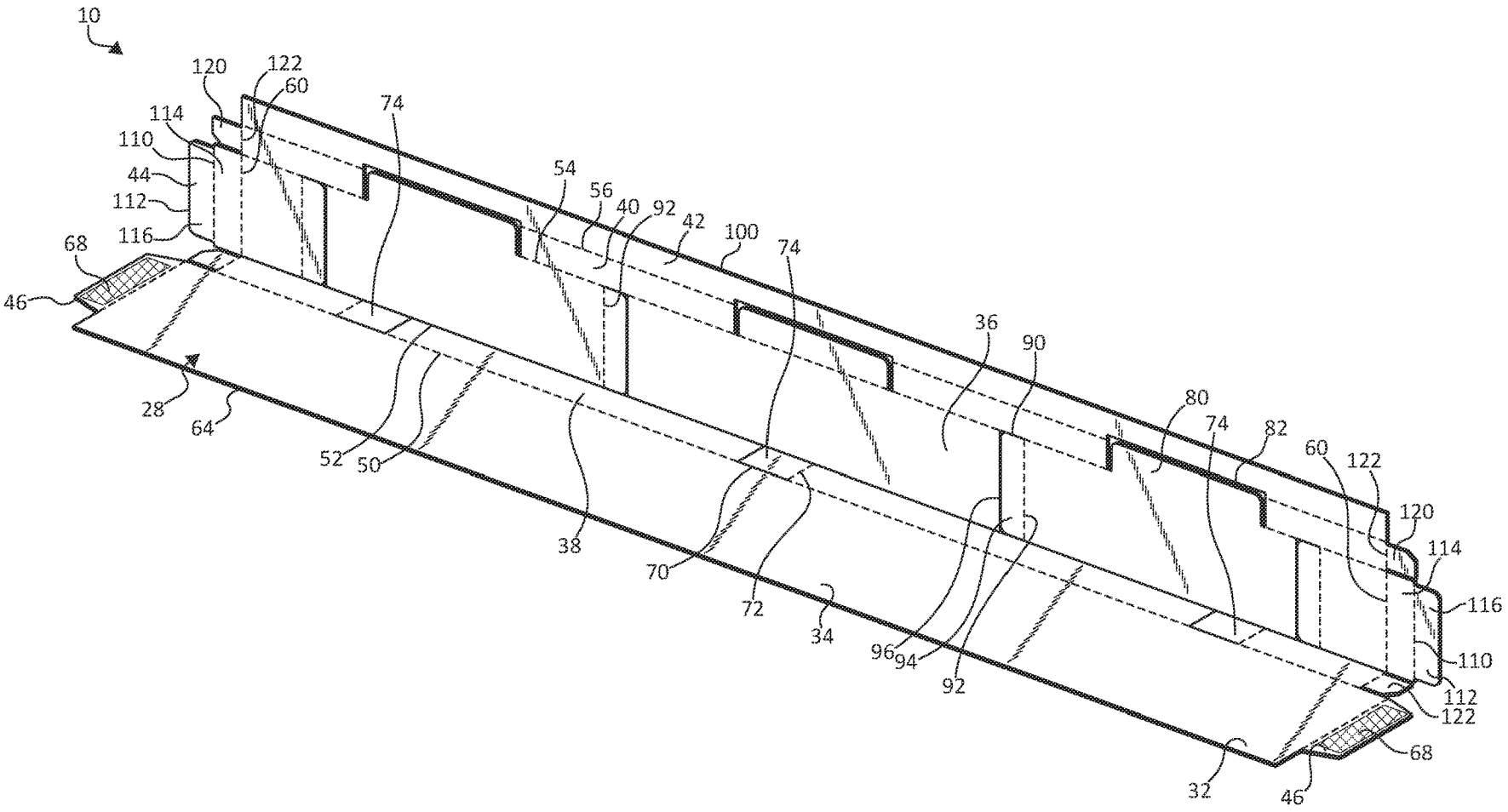
FIG. 13 is a rear perspective illustration of the header box blank of FIG. 11 in a partially folded position, according to one embodiment of the present invention.

Once blank 28 is cut from a planar material and fold lines and interior cut lines are formed, it is easily, stacked and flat packed for sending to a retail store or other suitable environment for assembly and use. Upon arrival of blank 28 at the retail store, for example, a team member can quickly assemble blank 28 into header box 10 and hang header box 10 on a cross bar 14 (see FIGS. 1 and 2) generally without the need for tools, coupling members, or any other additional items other than blank 28. One example of a process for assembling header box 10 is shown sequentially in FIGS. 13-15, which will be described herein in detail. Other sequences of the operations described are also contemplated and will be apparent to those of skill in the art upon reading the present application. As shown in FIG. 13, blank 28 is first placed so exterior surface 30 (see FIG. 11) is placed downwardly, preferably onto a hard surface (not shown), such as a table, floor, etc. and interior surface 32 faces upwardly therefrom. In this manner, any indicia 16 (see FIG. 11) faces away from the team member assembling blank 28 into header box 10.

Once blank 28 is so placed, blank 28 is folded upwardly about second fold line 52 that is rear panel 36, bottom panel 40, and longitudinal coupling flange 42 are collectively rotated upwardly about second fold line 52 to extend substantially perpendicularly from top panel 38 and front panel 34, which remain in their initial, coplanar position as illustrated in FIG. 13. Once so positioned, then each of spacing tabs 74 and 94 are rotated about their adjacent fold lines 72 and 92 respectively toward an interior of header box 10. More particularly, each of spacing tabs 74 are rotated inwardly from top panel 38 about an immediately adjacent fold line 72 to extend substantially perpendicularly to a remainder of top panel 38. Each of spacing tabs 94 are similarly rotated inwardly from a remainder of rear panel 36 about an immediately adjacent fold line 92 to extend substantially perpendicularly relative to a remainder of rear panel 36, in one embodiment. In one example, once so rotated, all of spacing tabs 74 and 94 extends substantially parallel relative to one another. In one embodiment, spacing tabs 74 and spacing tabs 94 have substantially similar front to back widths when folded into position.

Figure 14:
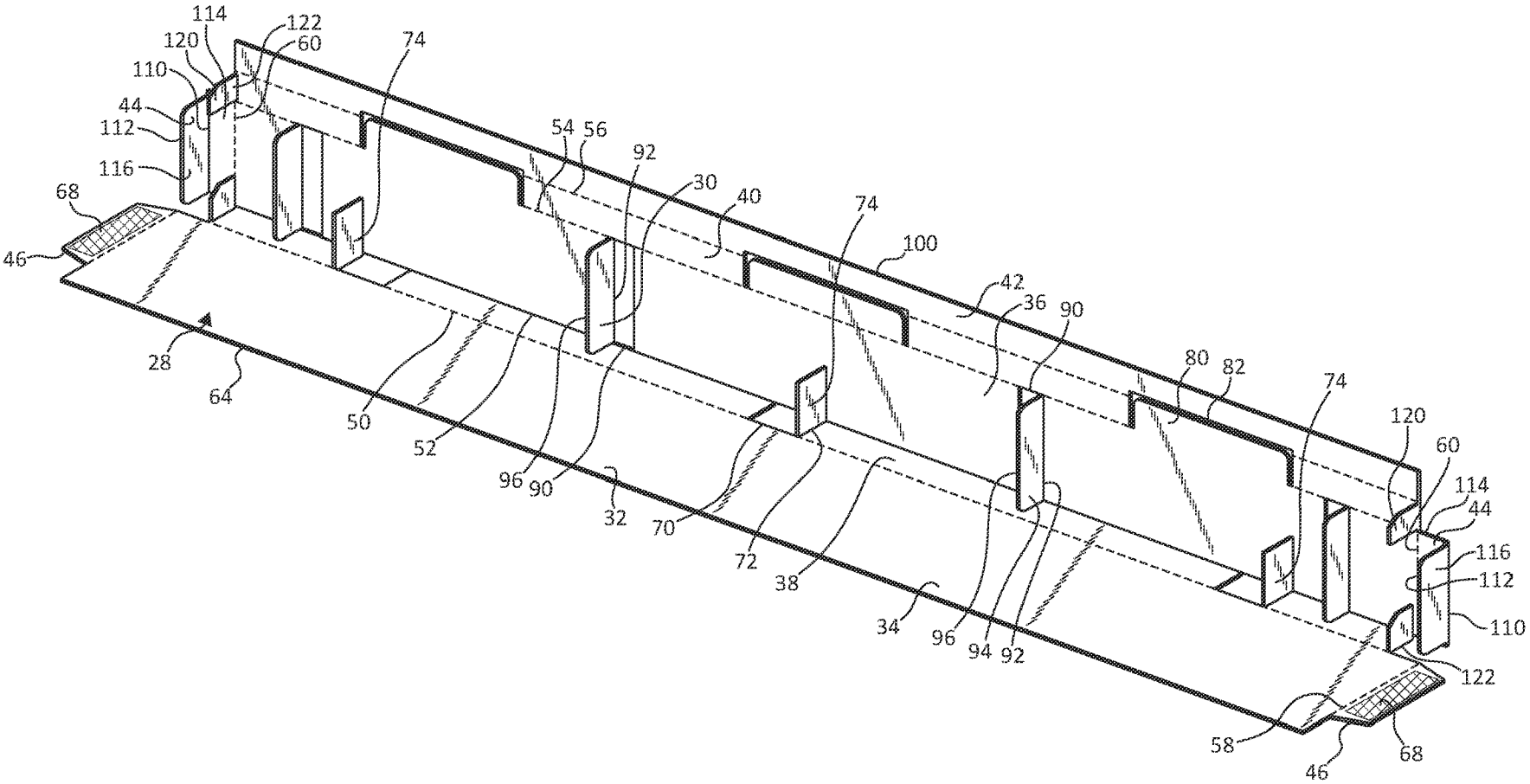
FIG. 14 is a rear perspective illustration of the header box blank of FIG. 11 in a partially folded position, according to one embodiment of the present invention.

In one example, at this stage, flanges 120 are also folded inwardly to extend forwardly from rear panel 36 about corresponding adjacent ones of fold lines 122 as illustrated in FIG. 14. Second portion 116 of side panel 44 is also folded about fold dividing fold line 110 to extends inwardly and substantially perpendicularly relative to first portion 114 of side panel 44.

Figure 15:
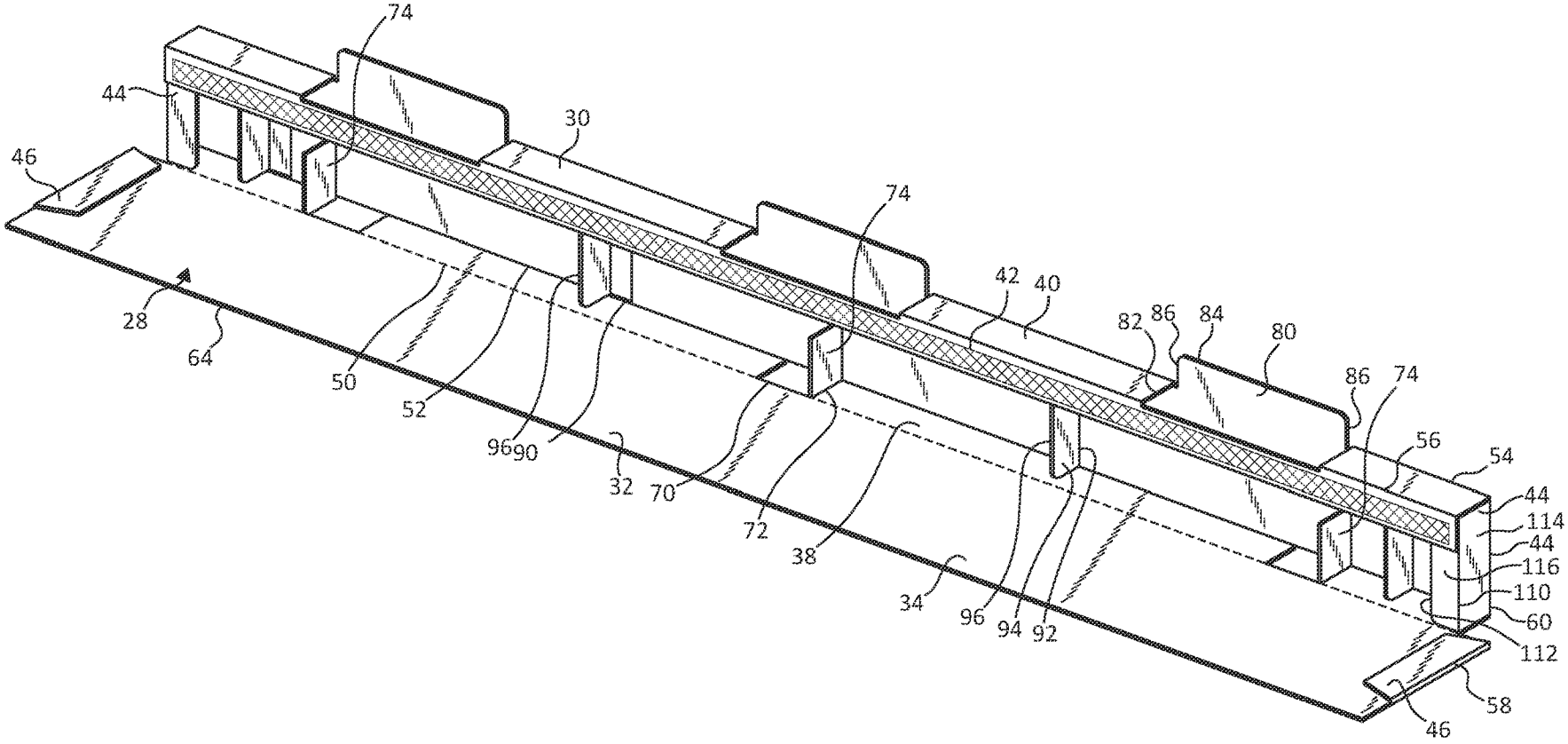
FIG. 15 is a rear perspective illustration of the header box blank of FIG. 11 in a partially folded position, according to one embodiment of the present invention.

Additionally, referring to FIG. 15, first portion 114 of side panel 44 is folded inwardly about adjacent ones of fold lines 122 to be substantially perpendicular with rear panel 36, and therefore, placing second portion 116 of side panel 44 to extending in front of, but substantially parallel with rear panel 36. Bottom panel 40 is folded about third fold line 54 toward top panel 38 until it contacts top edges of side panel 44 and extends substantially parallel to top panel 38. Longitudinal coupling flange 42 is folded about fourth fold line 56 toward top panel 38 until it contacts front edges of spacing tabs 94 and/or front surface of second portion 116 of side panel 44. In this manner, in one example, longitudinal coupling flange 42 extends substantially perpendicularly relative to bottom panel 40 and substantially parallel to rear panel 36.

Lateral finishing flanges 46 are rotated substantially about 180° about fold line 58 to adhere a portion of interior surface 32 formed by each lateral finishing flange 46 to a portion of interior surface 32 formed by opposing ends of front panel 34 and is adhered to front panel via adhesive 68. In this manner, a clean and aesthetically pleasing fold line 58 forms the edge of front panel 34, which is more aesthetically pleasing than a cut edge and reinforces edge of front panel 34 to prevent denting or other bending of front panel 34 at outer edges thereof and adding overall rigidity to header box 10.

In a final assembly step, according to one embodiment of assembling header box 10, front panel 34 is folded inwardly about first fold line 50 until a portion of interior surface 32 formed by front panel 34 contacts a portion of exterior surface 30 or adhesive 68 applied thereto, to secure front panel 34 in place in a folded position as illustrated in the assembled view of FIGS. 1-10. When so positioned, in one embodiment, front panel 34 extends substantially perpendicularly relative to top panel 38, first portion 114 of side panel 44, and bottom panel 40 and substantially parallel relative to rear panel 36. When in position, spacing tabs 74 and 94 either contact or are close to contacting front panel 34 in a manner configured to maintain front panel 34 away from rear panel 36 to prevent or least substantially decrease collapse of header box 10 and to increase overall rigidity of header box 10. Header box 10 is then inverted so top panel 38 forms the topmost surface of header box 10 for use in a display.

In its final assembled form, header box 10 defines a reception cavity 130 (see FIGS. 2 and 4) below bottom panel 40 between a portion of front panel 34 extending below bottom panel 40 and an interior surface of each of depending flanges 80, where depending flanges 80 are coplanarly formed and positioned with remainder of rear panel 36. More specifically, in one embodiment, front panel 34 is formed with a height that is at least substantially equal to or greater than an overall height of rear panel 36 including depending flanges 80. Since depending flanges 80 are intermittent along rear panel 36 the rear side of reception cavity is intermittently open.

Once fully assembled, header box 10, in one embodiment, is coupled to retail display fixture 12 by sliding header box 10 onto cross bar 14 of retail display fixture 12 such that cross bar 14 is snugly held in place in reception cavity 130. In this manner, in one example, a portion of interior surface 32 formed by the portion of front panel 34 extending below bottom panel 40 fits immediately adjacent to a front surface of cross bar 14, bottom panel 40 fits atop a top surface of cross bar 14, and the portion of interior surface 32 formed by depending flanges 80 of rear panel 36 fits immediately adjacent a rear surfaced of cross bar 14. In one embodiment, rear panel 36 and front panel 34 are positioned a distance relative to one another to hug or otherwise fit tightly around cross bar 14 holding header box 10 in place on cross bar 14 in a secure manner require no additional mechanism or agent to sit atop retail display fixture, for example, as shown in FIG. 1, although additional securement may be used in other embodiments. The longitudinal engagement of cross bar 14 between front panel 34 and depending flanges 80 also prevents undesired rotation or front to back movement of header box 10 relative to cross bar 14. This arrangement also allows header box 10 to be relatively easily lifted away from cross bar 14 and removed from retails display fixture 12 when desired. Since, in one embodiment, header box 10 is made of corrugated cardboard or paperboard, header box 10 is easily recyclable following use serving to reduce the environmental impact of use and disposal of header box 10.

Figure 16:
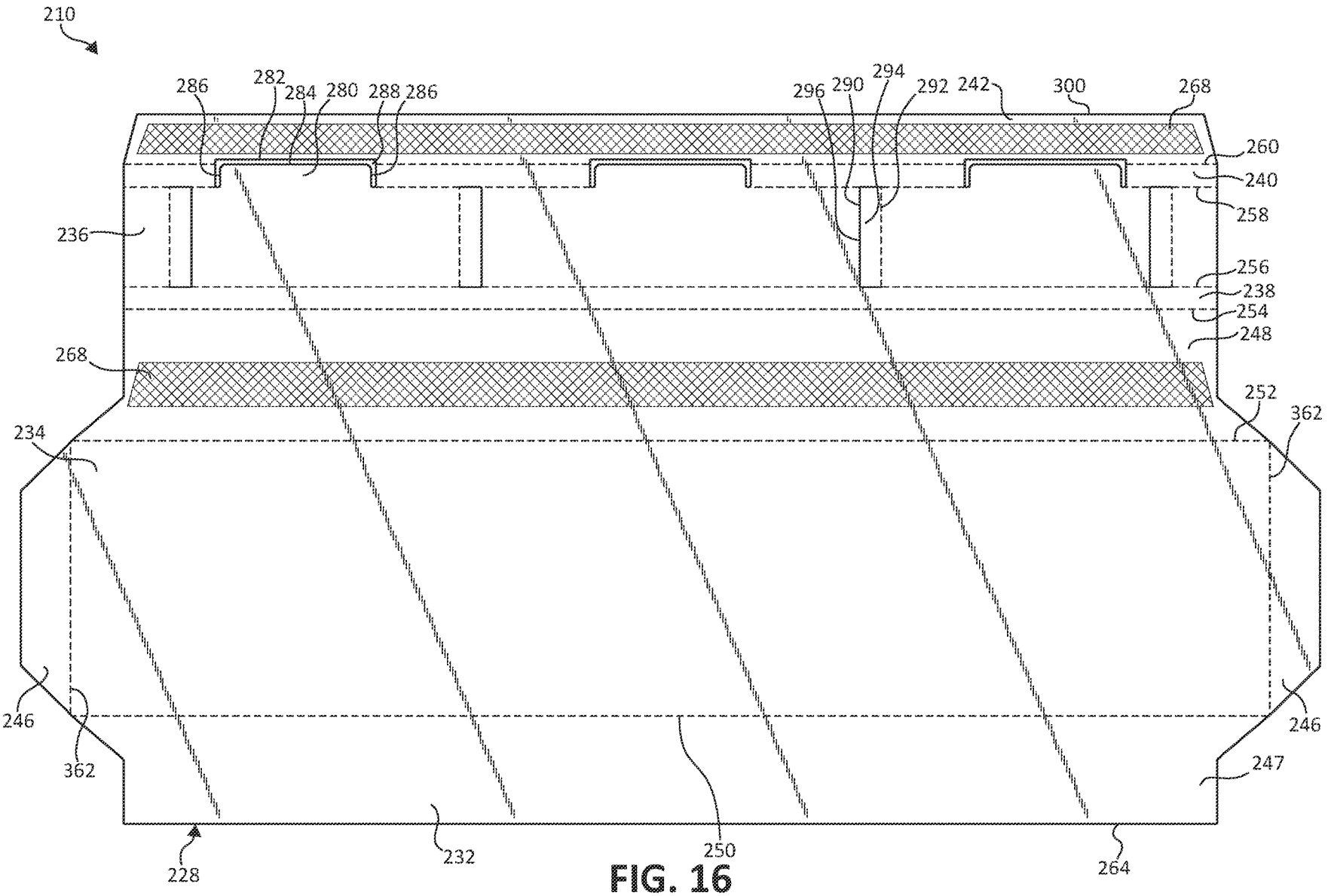
FIG. 16 is a rear view illustration of an unfolded header box blank, according to one embodiment of the present invention.

FIGS. 16-20 illustrate a header box 210, according to another embodiment of the present invention, using similar features and formation as header box 10 and, therefore, being described in abbreviated description below. Like header box 10 as shown in FIGS. 3-10, header box 210 is initially formed of a substantially planar member in the form of a blank 228 as shown in FIG. 16. Blank 228 is formed of paperboard, cardboard, pressed paper, plastic or other suitable material able to fold along defined fold lines and is configured with perforations cut therein to allow blank 228 to be folded to become header box 210. In one embodiment, blank 228 defines a first or exterior surface 2230 and a second or interior surfaced 32, opposite exterior surface 230. Each of exterior surface 230 and interior surface 232 are substantially planar and is in a parallel plane with the other of exterior surface 230 and interior surface 232.

Blank 228 is scored, marked, or otherwise formed with a plurality of fold lines 250, 252, 254, 256, 258, and 260, for example, defining a front panel 234, a rear panel 236, a top panel 238, a bottom panel 240, long coupling flange 242, lateral finishing flanges 246, top finishing flange 247, and bottom finishing flange 248, in one embodiment. For example, top finishing flange 247 extends from a bottom free edge 264 to a first fold line 250 in a substantially rectangular manner where bottom free edge 64 and first fold line 250 extend substantially parallel to one another. In one embodiment, front panel 234 extends from first fold line 250 away from top finishing flange 247 to second fold line 252 and is entirely continuous and/or includes indicia 16 (not shown, but see FIG. 1) printed on the portion of exterior surface 230 formed by front panel 234. Bottom finishing flange 248 extends from second fold line 252 to third fold line 254, in one embodiment and may include pre-applied adhesive 268 similar to adhesive 68 described above. Top panel 238 extends from third fold line 254, opposite front panel 234, to a fourth fold line 256, which, in one example, extends substantially parallel to first fold line 250.

Rear panel 236, according to one embodiment, generally extends from fourth fold line 256 along which it borders top panel 238 to fifth fold line 258, which, in one example, is substantially parallel to fourth fold line 256. Portions of rear panel 236, however, extend from fourth fold line 256 past and beyond fifth fold line 258 forming at least two depending flanges 280. More specifically, in one embodiment, a longitudinally orientated C-shaped slot 282 is formed around each one of depending flanges 280 defining three-sides of the perimeter of each depending flanges 280, that is extending from two ends of depending flanges 280 adjacent fifth fold line 258 toward and, in some embodiments, to or beyond sixth fold line 260. In this manner, each depending flange 280 extends from fifth fold line 258 to a free end 284, substantially parallel to sixth fold line 260 and two transverse edges s86 on either side thereof extending between free end 284 and fifth fold line 258. As such, each depending flange 280 is elongated in a longitudinal direction substantially parallel to fold lines 250, 252, 254, 256, 258, and 260.

Additionally, in one embodiment a transversely orientated, C-shaped slit 290 is formed through rear panel 236 in a manner extending from fourth fold line 256 to fifth fold line 258. More specifically, each C-shaped slit 290 includes front and back sections, each substantially colinear with a different one of fourth fold line 256 and fifth fold line 258, and a transverse section extending from one end of each front and back section to the other to form the C-shape of each C-shaped slit 290. A transverse fold line 292 extends from the ends of front and back sections of each one of C-shaped slits 290 opposite their intersection with transverse section of C-shaped slit 290. In one embodiment, transverse fold line 292 extends along a substantial entirety of a height of rear panel 236, that is from fourth fold line 256 to fifth fold line 258. The area of top panel inside C-shaped slit 290 and transverse fold line 292 serves as a spacing tab 294 foldable about fold line 292, as will be further described in assembly of header box 210. Each spacing tab 294 extends from a respective one of transverse fold lines 292 to a free end 296, extending substantially parallel to the respective one of transverse fold lines 292. In one embodiment, all of spacing tabs 294 are formed to extend in a single direction away from their respective fold line 292, while, in another embodiment, different ones of spacing tabs 294 extending in opposite direction way from their respective fold line 292 such that C-shaped slit 290 is in an opposite direction as compared with typical C-shape.

In one embodiment, bottom panel 240, extends away from fifth fold line 258 in a direction opposite rear panel 236 to sixth fold line 260, which, in one example, is substantially parallel to fifth fold line 258. In one embodiment, bottom panel 240 is discontinuous and is divided into segments by depending flanges 280 extending upwardly through bottom panel 240 from rear panel 236.

Longitudinal coupling flange 242 extends from sixth fold line 260 away from bottom panel 240 to a free end 300. In one embodiment, free end 300 extends substantially parallel with one or more of fold lines 250, 252, 254, 256, 258, and 260. In one embodiment, longitudinal coupling flange 42 is continuous longitudinally between opposing ends thereof, while in other embodiments, longitudinal coupling flange 242 is discontinuous.

In one embodiment, Longitudinal coupling flange 242 includes pre-applied adhesive 268 or is applied with adhesive 268 during assembly to hold header box 210 in an assembled position substantially without the use of other tools or securement mechanisms, in one example. Other portions of header box 210 may also make use of pre-applied or other adhesive 268 in assembling header box 210 as will be apparent to those of skill in the art upon reading the present application.

In one embodiment, header box 210 defines at least two lateral finishing flanges 246 each extending from an opposite end of front panel 234, more specifically, in one instance, from a transverse fold line 362 at least partially defining an end of front panel 234. Each lateral finishing flange 246 extends away from the front panel 234 end to a free end. Each lateral finishing flange 246 is of equal or lessor height as front panel 234.

Figure 17:
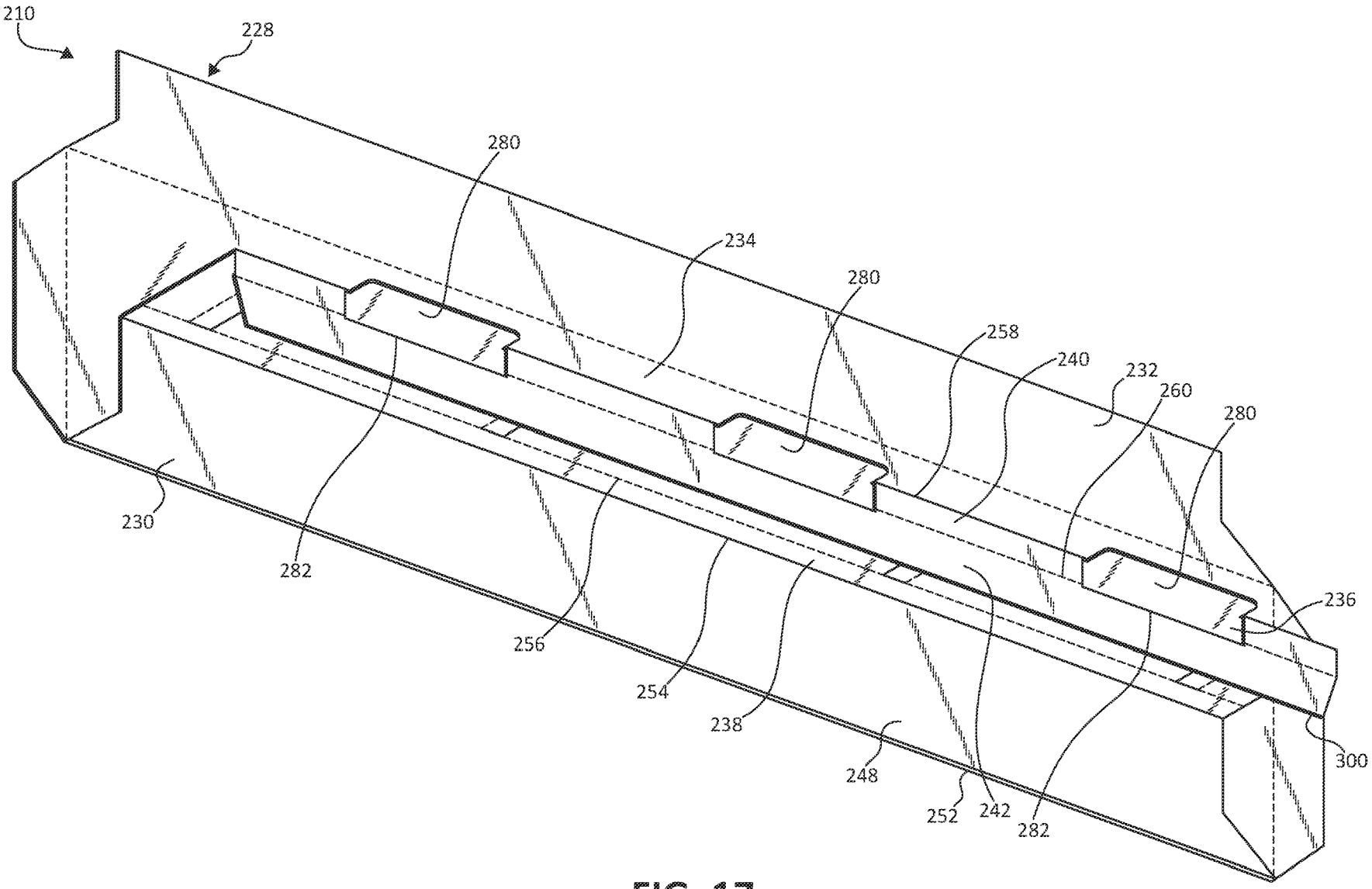
FIG. 17 is a rear perspective illustration of the header box blank of FIG. 16 in a partially folded position, according to one embodiment of the present invention.
Figure 18:
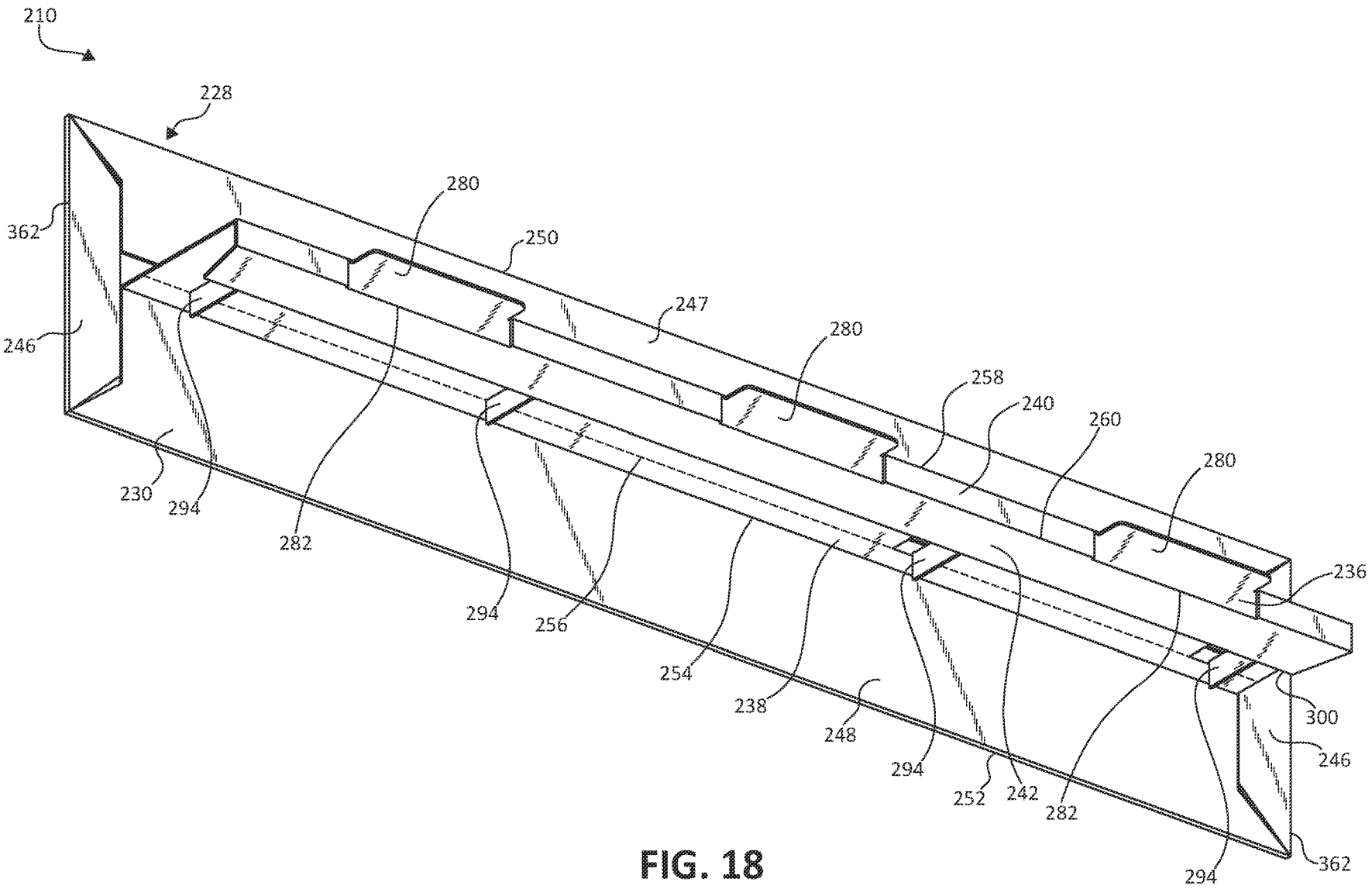
FIG. 18 is a rear perspective illustration of the header box blank of FIG. 16 in a partially folded position, according to one embodiment of the present invention.
Figure 19:
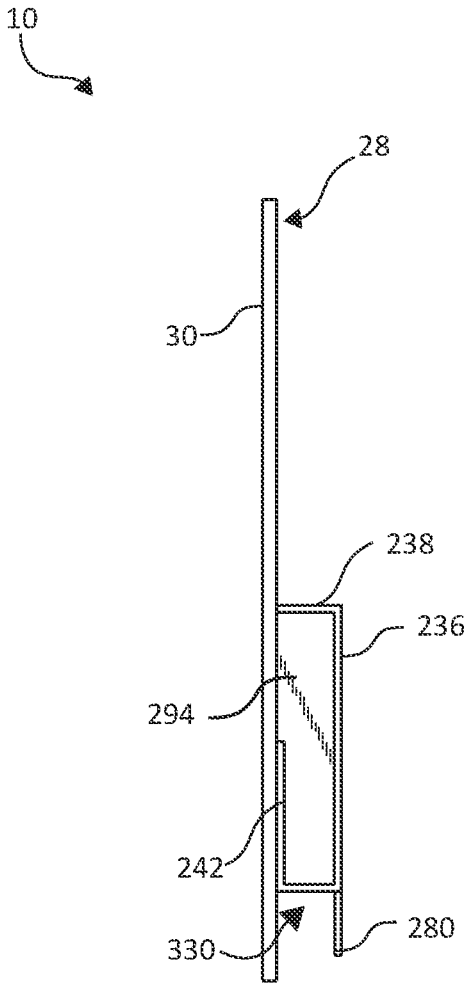
FIG. 19 is a right side view illustration of the header box of FIG. 16 in a fully assembled position, according to one embodiment of the present invention.
Figure 20:
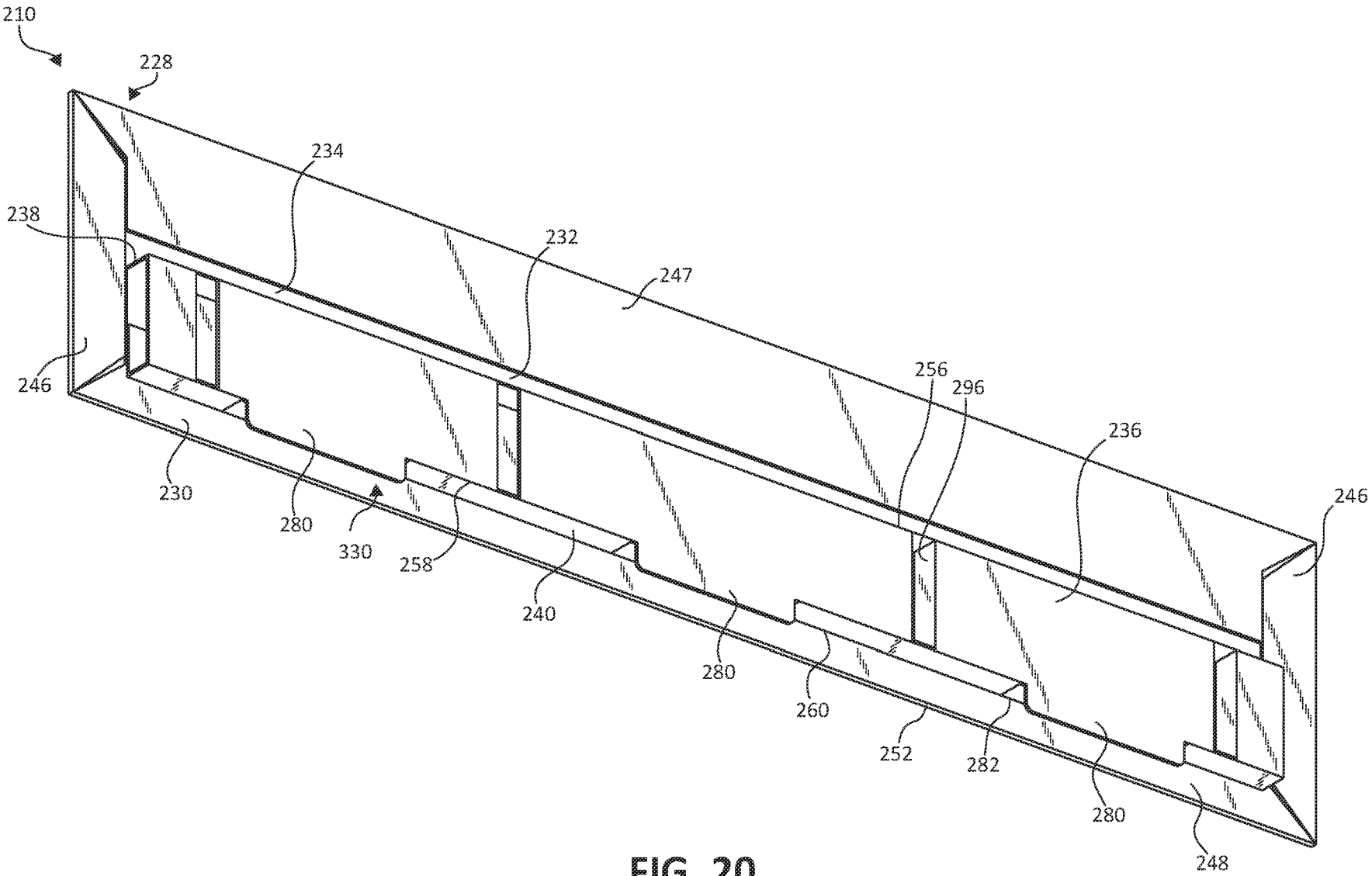
FIG. 20 is a rear perspective view illustration of the header box of FIG. 16 in a fully assembled position, according to one embodiment of the present invention.

Once blank 228 is cut from a planar material and fold lines and interior cut lines are formed, it is easily, stacked and flat packed for sending to a retail store or other suitable environment for assembly and use. Upon arrival of blank 228 at the retail store, for example, a team member can quickly assemble blank 228 into header box 210 and hang header box 210 on a cross bar 14 in a similar manner as shown for header 10 in FIGS. 1 and 2, generally without the need for tools, coupling members, or any other additional items other than blank 228. One example of a process for assembling header box 210 is shown sequentially in FIGS. 17-20, which will be described herein in detail. Other sequences of the operations described are also contemplated and will be apparent to those of skill in the art upon reading the present application. As shown in FIG. 17, blank 228 is first placed so exterior surface 230 (see FIG. 17) is placed downwardly, preferably onto a hard surface (not shown), such as a table, floor, etc. and interior surface 232 faces upwardly therefrom. In this manner, any indicia 16 (see FIG. 1) faces away from the team member assembling blank 228 into header box 210.

Once blank 228 is so placed, the portion of blank 228 forming bottom finishing flange 248 is folded upwardly about second fold line 252 to lay on top of font panel 234, and bottom finishing flange 248 is pressed against front panel 234 engaging adhesive 268 and securing bottom finishing flange 248 to front panel 234. Then, top panel 238 is folded outwardly along third fold line 254 to extend substantially perpendicularly to each of front panel 234 and bottom finishing flange 248. Bottom panel 2402 and longitudinal coupling flange 242 are each rotated forwardly and then toward front panel 234 from fifth fold line 258 and sixth fold line 260, respectively.

Once so positioned, then each of spacing tabs 294 are rotated about their adjacent fold lines 292 respectively toward an interior of header box 210. More particularly, each of spacing tabs 294 are similarly rotated inwardly from a remainder of rear panel 2236 about an immediately adjacent fold line 92 to extend substantially perpendicularly relative to a remainder of rear panel 236, in one embodiment. In one example, once so rotated, all of spacing tabs 294 extends substantially parallel relative to one another. In one embodiment, spacing tabs 294 have substantially similar front to back widths when folded into position. Rear panel 236 is then folded downwardly about fourth fold line 256 until rear panel 236 is positioned substantially perpendicularly to top panel 238 and substantially parallel to front panel 234. In this position, then longitudinal coupling flange 242 is adhered to bottom finishing flange 248 opposite front panel 234. When so secured, bottom panel 242 extends substantially parallel to top panel 238 and substantially perpendicularly to front panel 234, bottom finishing flange 248, and rear panel 236 to form a rectangular box like structure best appreciated in the side view of FIG. 19.

Lateral finishing flanges 246 are rotated substantially about 180° about transverse fold line 362 to adhere a portion of interior surface 232 formed by front panel 234 and is adhered to front panel 234 via adhesive 68. In one embodiment, each of lateral finishing flanges 246, top finishing flange 247, and bottom finishing flange 248 make use of mitered corners for a clean and neat, and non-overlapping securement to front panel 234. In this manner, a clean and aesthetically pleasing fold line 362 forms the edge of front panel 234, which is more aesthetically pleasing than a cut edge and reinforces edge of front panel 234 to prevent denting or other bending of front panel 234 at outer edges thereof and adding overall rigidity to header box 210.

When so assembled, in one embodiment, front panel 234 extends substantially perpendicularly relative to top panel 238, and bottom panel 240 and substantially parallel relative to rear panel 236. When in position, spacing tabs 294 either contact or are close to contacting bottom finishing flange 248 in a manner configured to maintain front panel 234 away from rear panel 236 to prevent or least substantially decrease collapse of header box 210 and to increase overall rigidity of header box 210.

In its final assembled form, header box 10 defines a reception cavity 330 (see FIGS. 19 and 20) below bottom panel 240 between a portion of front panel 234, more particularly, bottom finishing flange 248, extending below bottom panel 240 and an interior surface of each of depending flanges 280, where depending flanges 280 are coplanarly formed and positioned with remainder of rear panel 236. More specifically, in one embodiment, front panel 234 is formed with a height that is at least substantially equal to or greater than an overall height of rear panel 236 including depending flanges 280. Since depending flanges 280 are intermittent along rear panel 236 the rear side of reception cavity 330 is intermittently open.

Once fully assembled, header box 210, like header box 10, in one embodiment, is coupled to retail display fixture 12 (FIGS. 1 and 2) by sliding header box 210 onto cross bar 14 of retail display fixture 12 such that cross bar 14 is snugly held in place in reception cavity 330. Header box 210 is selectively secured to cross bar 14 similarly as described above with respect to header box 10 and is similarly removable for relocation, later use, or recycling.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A header box configured to be coupled to a retail display structure, the header box comprising:

a front panel having a bottommost edge;

a rear panel initially formed coplanarly with the front panel and folded about a first fold line of the header box relative to the front panel to extend entirely spaced from and substantially parallel to the front panel, wherein the rear panel includes at least one depending flange extending downwardly from other portions of the rear panel; and a bottom panel initially formed coplanarly with each of the front panel and the rear panel and bordering the rear panel about a second fold line, the bottom panel being folded about the second fold line to extend between the rear panel and the front panel, and the bottom panel being positioned above the bottommost edge of the front panel and above the at least one depending flange of the rear panel;

wherein a reception cavity is formed between the front panel and the at least one depending flange and below the bottom panel for slidably receiving a cross bar of the retail display structure such that the bottom panel contacts the cross bar and the header box fits atop the cross bar.

2. The header box of claim 1, wherein the front panel, the rear panel, and the bottom panel are all integrally formed as part of a single piece of a substantially planar material.

3. The header box of claim 2, wherein the substantially planar material is corrugated cardboard.

4. The header box of claim 1, wherein the at least one depending flange is one of at least two depending flanges formed by the rear panel and extending downwardly from the other portions of the rear panel, the two depending flanges being longitudinally spaced from one another along a length of the rear panel.

5. The header box of claim 1, wherein:

the rear panel additionally includes:

a rear transverse fold line extending along a substantial entirety of a height of the rear panel, and a C-shaped cutout extending from either end of the rear transverse fold line to form a rear spacing tab between the rear transverse fold line and the C-shape cutout, and the rear spacing tab being inwardly folded about the rear transverse fold line to extend substantially parallel to the other portions of the rear panel and to contact an interior surface of the front panel opposite the other portions of the rear panel to substantially maintain spacing between the rear panel and the front panel above the bottom panel.

6. The header box of claim 5, further comprising a top panel opposite the bottom panel, wherein:

the top panel additionally includes:

a top transverse fold line extending along a substantial entirety of a width of the bottom panel, and a C-shaped cut extending from either end of the top transverse fold line to form a top spacing tab between the top transverse fold line and the C-shape cut, and the top spacing tab being inwardly folded about the top transverse fold line to extend substantially parallel to other portions of the top panel and to contact the interior surface of the front panel and an interior surface of the rear panel to substantially maintain spacing between the rear panel and the front panel above the bottom panel.

7. The header box of claim 1, further comprising a top panel opposite the bottom panel, wherein:

the top panel additionally includes:

a top transverse fold line extending along a substantial entirety of a width of the top panel, and a C-shaped cut extending from either end of the top transverse fold line to form a top spacing tab between the top transverse fold line and the C-shape cut, and the top spacing tab being inwardly folded about the bottom transverse fold line to extend substantially parallel to other portions of the top panel and to contact an interior surface of the front panel and an interior surface of the rear panel to substantially maintain spacing between the rear panel and the front panel above the bottom panel.

8. The header box of claim 1, further comprising a lateral finishing flange extending from a finishing fold line at an end of the front panel, the lateral finishing flange being folded about the finishing fold line back against an interior surface of the front panel and being adhered to the front panel to add rigidity to the front panel.

9. The retail display system of claim 8, wherein the front panel, the rear panel, and the bottom panel are all integrally formed as part of a single piece of a substantially planar material.

10. The header box of claim 1, further comprising a top panel opposite the bottom panel and extending between the front panel and the rear panel.

11. The header box of claim 10, further comprising a longitudinal finishing flange folded downwardly from a topmost edge of the top panel and being adhered to the interior surface of the front panel, the longitudinal finishing flange terminating above the rear panel.

12. The header box of claim 10, wherein the top panel extends from a topmost edge of the front panel.

13. The header box of claim 10, wherein the depending flange extends a distance from the top panel substantially identical to a distance the bottom edge of the front panel extends from the top panel.

14. The header box of claim 10, wherein the top panel is positioned below the topmost edge of the front panel.

15. The header box of claim 10, wherein a top finishing flange extends from the topmost edge of the front panel and is folded back about and adhered to an interior surface of the front panel above the top panel to add rigidity to the front panel.

16. The header box of claim 1, in combination with a retail fixture having the cross bar, wherein the header box is selectively coupled to the cross bar by receiving the cross bar within the reception cavity, supporting the bottom panel atop the cross bar, and maintaining the cross bar between the font panel and the depending flanges of the rear panel.

17. The header box and retail fixture combination of claim 16, wherein the cross-sectional shape and size of the cross bar is substantially identical to the cross-sectional shape and size of the reception cavity.

18. A retail display system comprising:

a retail display fixture including:

one of a shelf and a rod for supporting items offered for retail sale, and a cross bar extending substantially horizontally in orientation; and a header box comprising:

a front panel having a bottommost edge, a rear panel initially formed coplanarly with the front panel and folded about a first fold line of the header box relative to the front panel to extend entirely spaced from and substantially parallel to the front panel, wherein the rear panel includes at least one depending flange extending downwardly from other portions of the rear panel, and a bottom panel initially formed coplanarly with each of the front panel and the rear panel and bordering the rear panel about a second fold line, the bottom panel being folded about the second fold line to extend between the rear panel and the front panel, and the bottom panel being positioned above the bottommost edge of the front panel and above the at least one depending flange of the rear panel;

wherein a reception cavity is formed between the front panel and the at least one depending flange and below the bottom panel, and the header box receives the cross bar of the retail display structure such that the bottom panel contacts the cross bar so the header box fits atop the cross bar and the cross bar is contacted by and maintained between the front panel and the depending flange.

19. The retail display system of claim 18, wherein:

the rear panel additionally includes:

a rear transverse fold line extending along a substantial entirety of a height of the rear panel, and a C-shaped cutout extending from either end of the rear transverse fold line to form a rear spacing tab between the rear transverse fold line and the C-shape cutout, and the rear spacing tab being inwardly folded about the rear transverse fold line to extend substantially parallel to the other portions of the rear panel and to contact an interior surface of the front panel opposite the other portions of the rear panel to substantially maintain spacing between the rear panel and the front panel above the bottom panel.

* * * * *